US007856857B2

(12) United States Patent
Tsai

(10) Patent No.: US 7,856,857 B2
(45) Date of Patent: Dec. 28, 2010

(54) DOOR LOCK OF KEY-DRIVEN TRANSMISSION STRUCTURE

(75) Inventor: Miao-Hsueh Tsai, Taichung (TW)

(73) Assignee: Imperial Hardware Taiwan, Ltd., Taichung (TW)

( * ) Notice: Subject to any disclaimer, the term of this patent is extended or adjusted under 35 U.S.C. 154(b) by 0 days.

(21) Appl. No.: 12/253,986

(22) Filed: Oct. 19, 2008

(65) Prior Publication Data

US 2010/0251786 A1 Oct. 7, 2010

(30) Foreign Application Priority Data

Dec. 17, 2007 (TW) ..... 096221479

(51) Int. Cl.
*E05B 59/00* (2006.01)
*E05B 63/14* (2006.01)

(52) U.S. Cl. ..... 70/107; 70/108; 292/34; 292/36

(58) Field of Classification Search ..... 70/107–111, 70/118, 120; 292/33–36
See application file for complete search history.

(56) References Cited

U.S. PATENT DOCUMENTS 6,266,981 B1 * 7/2001 von Resch et al. ..... 70/107
7,707,862 B2 * 5/2010 Walls et al. ..... 70/107
7,752,875 B2 * 7/2010 Constantinou et al. ..... 70/107
2003/0159478 A1 * 8/2003 Nagy ..... 70/107
2004/0107746 A1 * 6/2004 Chang ..... 70/107
2004/0261475 A1 * 12/2004 Artsiely ..... 70/107
2005/0166647 A1 * 8/2005 Walls et al. ..... 70/107
2009/0266120 A1 * 10/2009 Tien ..... 70/107

* cited by examiner

*Primary Examiner*—Lloyd A Gall
(74) *Attorney, Agent, or Firm*—Wang Law Firm, Inc.; Li K. Wang

(57) ABSTRACT

A door lock of key-driven transmission structure which is comprised of a case, a swing arm, a first link bar and a second link bar, whereof the first and second link bars and a lock-bolt structure on the case can be driven by the swing arm to open or close lock. A first transmission piece is driven when the lock-bolt structure is actuated, and an actuator is driven by the first transmission piece to further drive the two top and bottom pull rods which further drive the two top and bottom lock-bolts to extend outward for locking, thereby to reach a combining action between the lock-bolt structure as well as the top and bottom lock-bolts. The lock-bolt structure is further through linking with a labor saving component installed on the second link bar to achieve the labor saving and easy operation effects.

12 Claims, 8 Drawing Sheets

DOOR LOCK OF KEY-DRIVEN TRANSMISSION STRUCTURE

BACKGROUND OF THE INVENTION (a) Field of the Invention

The invention is related to a door lock of key-driven transmission structure, especially to a door lock structure which has the advantages of labor saving and convenience in key-rotation operation.

(b) Description of the Prior Art

A single-lock design is usually used in the conventional door lock, i.e. a single key is matched with a single lock for lock opening and closing. The most commonly used locks such as the cylinder locks, because of their singular structure, the lock can be easily pried out by a burglar with a tool to open the door and endanger the safety of residence.

There is another kind of lock which is constituted by a lock-bolt mechanism and a lock-tongue mechanism, whereof the lock-bolt mechanism is directly operated by a key for door lock closing and opening, while the lock-tongue mechanism has an outward extending lock-tongue structure as in a cylinder lock, whereof the said lock-tongue mechanism can be operated by pressing and rotation and allow the door to be temporarily closed by only combined the lock-tongue structure and the lock-hole of the door frame when the said lock-bolt mechanism is not yet locked.

Nonetheless, the lock with the above said lock-bolt mechanism and lock-tongue mechanism is not adequate enough to provide perfect household safety, since the lock-tongue mechanism only provides a temporary locking function while the actual door locking is still relied on the lock-bolt mechanism to provide. Therefore, it is the same as the simple single lock described above, if the lock-bolt mechanism is damaged by a burglar, its lock closing function will be lost to maintain the burglarproof function and that is a thing to be worried about.

There are other people propose that the lock-bolt mechanism can be combined with other auxiliary locks to enhance the burglarproof effect. However, due to the poor design of the other auxiliary locks, it is more labor demanding or the locking action cannot be reached at the same time with the auxiliary locks, such as that there are numerous inconveniences regarding this, so there are plenty of rooms for modifications.

SUMMARY OF THE INVENTION

The main purpose of the invention is aiming to solve the above said problems by providing a door lock of key-driven transmission structure which is comprised of a first link bar, a second link bar and a lock-bolt structure, etc for combined actions while in cooperation with a design of the labor saving component (i.e. torsion spring), the user can lock close or open the door in a more labor saving and convenient way.

The second purpose of the invention is through the double design of a main lock-bolt structure with the two top and bottom auxiliary lock-bolt to enhance the burglarproof effect.

To achieve the above purposes, the invention is comprised of:

A case, whereof one side of the said case has a lock-bolt through hole and a lock-tongue through hole:

A lock-bolt structure is transversely installed on the case, whereof the said lock-bolt structure is installed with a lock-bolt head which can be extended through the lock-bolt through hole, and the said lock-bolt structure is further installed with a first transverse guide slot, which is entered by a rod of the base plate of the case, and a longitudinal slot is provided at the outer edge between the said lock-bolt head and the said first transverse guide slot on the said lock-bolt structure;

A swing arm is hinged on the base plate of case and is on the opposite side of the longitudinal slot of the said lock-bolt structure;

A first link bar, which has one end is hinged with another end of the said swing arm, and the said first link bar is strode across the said lock-bolt structure, whereof a guide slot is installed between the two ends of a first link bar and is inserted by the said rod, whereby when the first link bar is driven by the swing arm, rotation of the first link bar is limited by the said rod;

A second link bar, which has one end hinged with another end of the first link bar and is driven by it to rotate, the another end of the second link bar is hinged on the lock-bolt structure near the said longitudinal slot, whereby the lock-bolt structure is driven by rotation of the said second link bar to translate transversely and make the lock-bolt head to shrink in or extend out through the lock-bolt through hole correspondingly;

A labor saving component is installed on the said second link bar, whereof the said labor saving component is respectively connected with the first link bar and the said lock-bolt structure, thereby to make the transverse translation of the said lock-bolt structure in a more labor saving and convenient way;

A first transmission piece is hinged on the base plate of case near the longitudinal slot, the first transmission piece has a first end and a second end, whereof the first end is inserted into the longitudinal slot, thereby when the lock-bolt structure is translated transversely, the first end is driven by the longitudinal slot to rotate the first transmission piece;

An actuator which is provided with a transverse slot corresponding to the second end of the first transmission piece, further, the top and bottom ends of the actuator are respectively connected with a pull rod, whereof each pull rod is connected with an auxiliary lock-bolt, and the actuator and the two pull rods are driven by the transmission piece to move up and down to push the two top and bottom lock-bolt out for locking action;

At least one push piece which is hinged on the case and has a push face;

A second transmission piece is hinged on the said case, in which the said second transmission piece has a third end and a fourth end, whereof the third end is installed against and pushed by the push piece, and the rotating direction of the said push piece is different from the rotating direction of the second transmission piece.

A lock-tongue structure which is transversely installed on the said case, whereof the said lock-tongue structure is installed with a lock-tongue head which can be extended through the lock-tongue through hole, further, a stop part is installed at the opposite end on the lock-tongue structure far away from the lock-tongue head, whereof the side facing lock-tongue of the said stop part is pushed against by the fourth end of the second transmission piece, whereby the said stop part is pushed by the hinged rotation of the second transmission piece to make the said lock-tongue structure translate inward transversely. Another side of the said stop part is pushed by an elastic component installed on the case to make the said lock-tongue structure translate to the said lock-tongue through hole transversely.

DETAILED DESCRIPTION OF THE PREFERRED EMBODIMENTS

Figure 1:
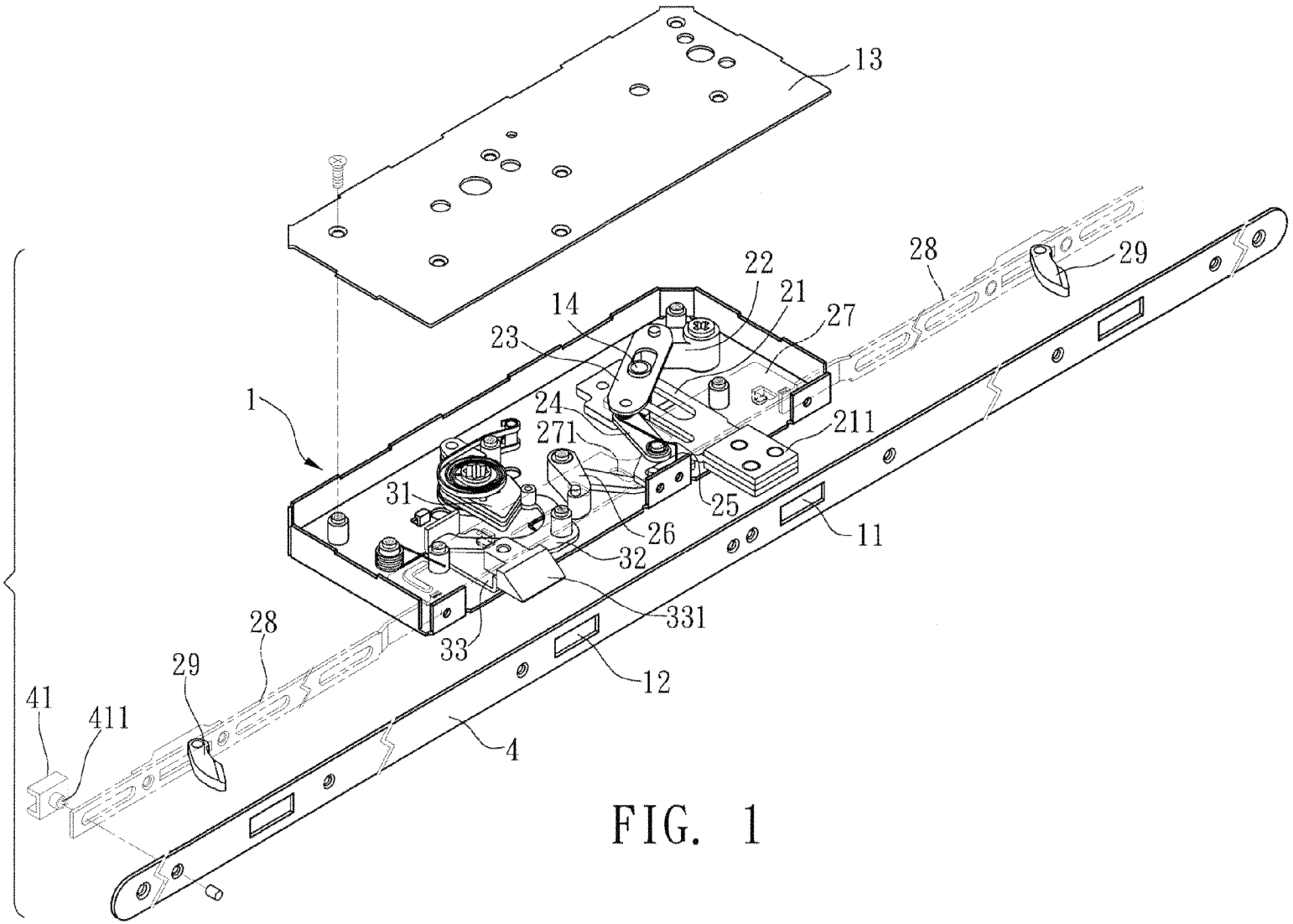
FIG. 1 is a partial decomposition schematic drawing of the door lock of the invention.
Figure 2:
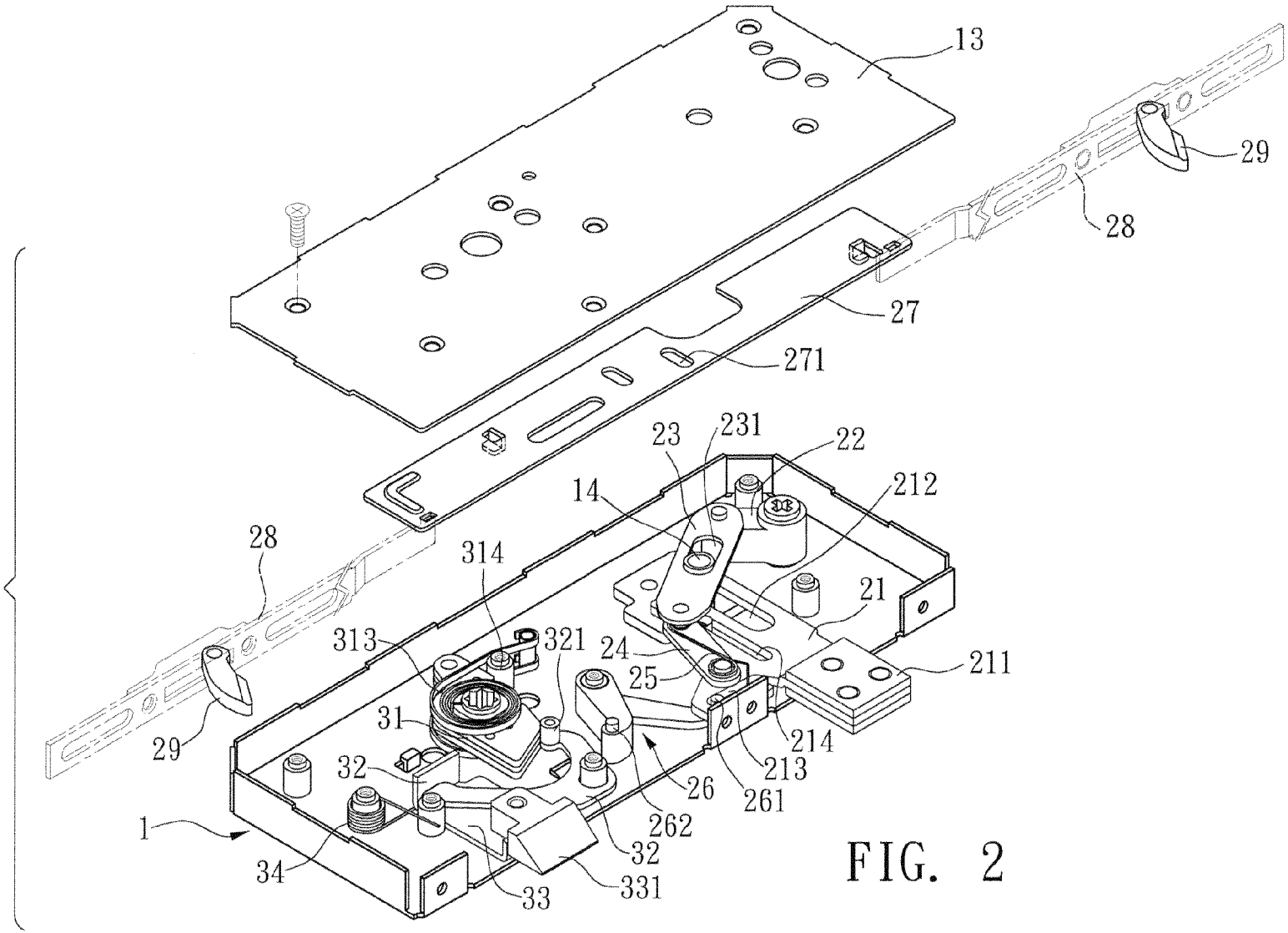
FIG. 2 is an enlarged schematic view of FIG. 1, whereof the separating plate is removed temporally for easy description.
Figure 3:
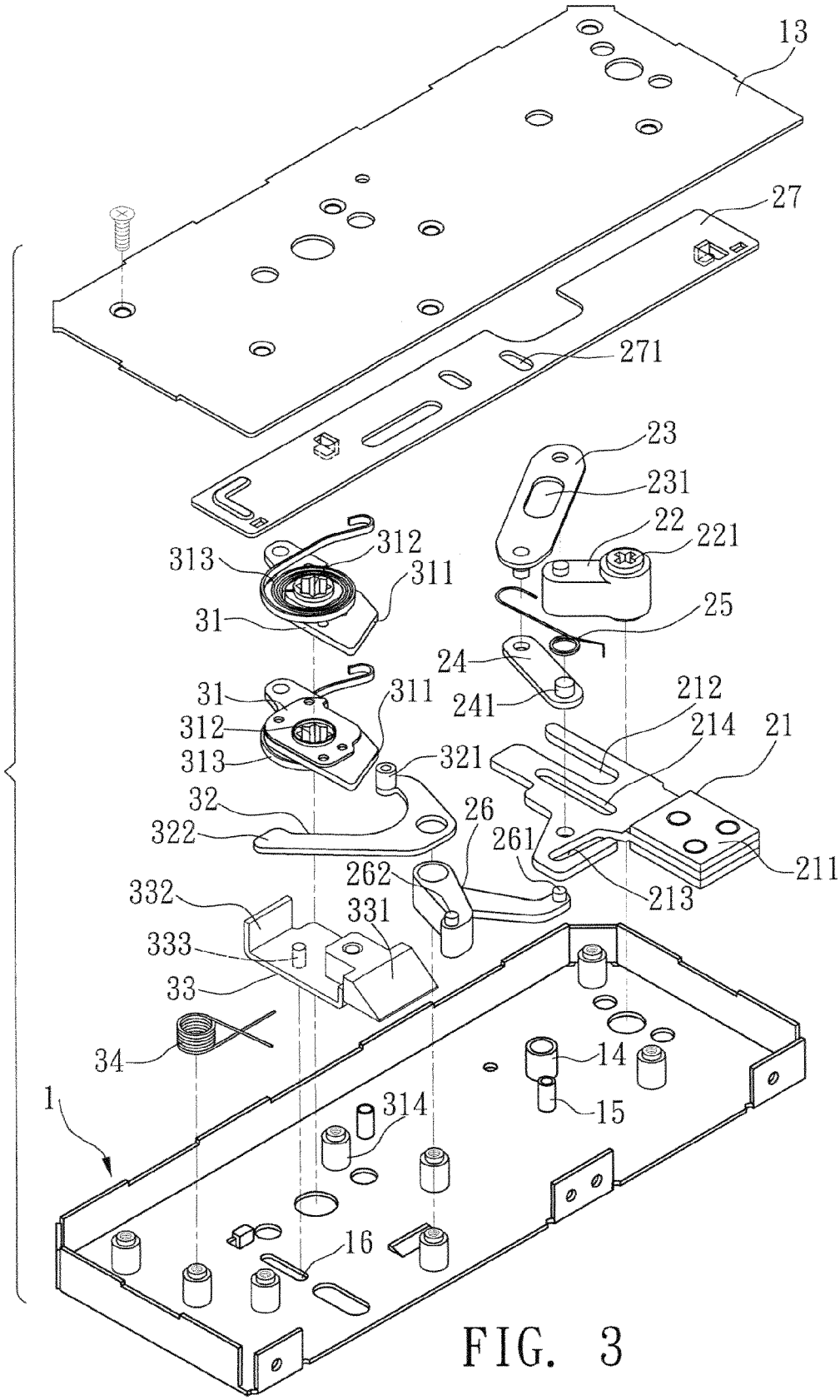
FIG. 3 is a further decomposed schematic view of FIG. 2.

Please refer to FIGS. 1~8, whereof the embodying structures of the invention shown in the drawings are only for description purposes which is not meant to limit the scope of patent application.

The embodiment of the door lock of key-driven transmission structure of the invention is described in the following, whereof the said door lock is installed at the side of a door and is comprised of the following:

A case 1 in rectangular shape, whereof one side of the said case has a lock-bolt through hole 11 and a lock-tongue through hole 12, a cover plate 13 is further provided on top of the case 1 for closing with it.

A lock-bolt structure 21 in rectangular shape which is transversely installed on the bottom plate of the case 1, whereof the lock-bolt structure 21 is installed with a lock-bolt head 211 which can be extended through the lock-bolt through hole 11, and the lock-bolt structure 21 is further installed with a first transverse guide slot 212, which is entered by rod 14 of the base plate of the case 1, and a longitudinal guide slot 213 is provided at the outer edge between the lock-bolt head 211 and the first transverse guide slot 212 on the lock-bolt structure 21. In the embodying example, a second transverse guide slot 214 parallel to the first transverse guide slot 212 is further provided on the lock-bolt structure 21, whereof the second transverse guide slot 214 is inserted by a stud 15 on the base plate of the case 1 to make the transverse translation of the lock-bolt structure 21 more stable.

A swing arm 22 is hinged on the base plate of case 1 and is on the opposite side of the longitudinal slot 213 of the said lock-bolt structure 21. In the embodying example, the hinge of the said swing arm 22 is installed with a lock-hole 221 to be inserted by a rotating knob (not shown in the drawing) for driving by key for opening and closing, whereby the said swing arm 22 is driven by the rotating knob when user open or close the lock with a key.

A first link bar, which has one end hinged with another end of the said swing arm 22, and the said first link bar 23 is strode across the said lock-bolt structure 21, whereof a guide slot 231 is installed between the two ends of a first link bar 23 and is inserted by the said rod 14, whereby when the first link bar 23 is driven by the swing arm 22, rotation of the first link bar 23 is limited by the said rod 14. In which, the rotating direction of the first link bar 23 is contrary to the rotating direction of the said swing arm 22.

A second link bar 24, which has one end hinged with another end of the first link bar 23 and is driven by it to rotate, the another end of the second link bar 24 is hinged on the lock-bolt structure 21 near the said longitudinal slot 213, whereby the lock-bolt structure 21 is driven by rotation of the said second link bar 24 to translate transversely and make the lock-bolt head 211 to shrink in or extend out through the lock-bolt through hole 11 correspondingly.

A labor saving component 25 is installed on the second link bar 24, whereof the labor saving component 25 is connected with the first link bar 23 and the said lock-bolt structure 21, thereby to make the transverse translation of the lock-bolt structure 21 in a more labor saving and convenient way. In the embodying example, the labor saving component 25 is a torsion spring which is placed on a hinge rod 241 at and hinges between the second link bar 24 and the lock-bolt structure 21, whereof one end of the labor saving component 25 is connected to a hinge between the first link bar 23 and the second link bar 24 and the another end is connected to the longitudinal slot 213 on the lock-bolt structure 21. A labor saving component 25 is installed on the second link bar 24, whereof the labor saving component 25 is respectively connected with the first link bar 23 and the lock-bolt structure 21, thereby to make the transverse translation of the lock-bolt structure 21 in a more labor saving and convenient way. In the embodying example, the labor saving component 25 is a torsion spring which is ringed on a hinge rod 241 and hinges between the second link bar 24 and the lock-bolt structure 21, whereof one end of the labor saving component 25 is connected to a hinge that is between the first link bar 23 and the second link bar 24 and the another end is placed adjacent to the longitudinal slot 213 on the lock-bolt structure 21.

A V shaped first transmission piece 26 is hinged on the base plate of case 1 near the said longitudinal slot 213 at its V shaped bend. The said first transmission piece 26 has a first end 261 and a second end 262, whereof the first end 261 is inserted upward from the bottom of the said lock-bolt structure 21 into the longitudinal slot 213, thereby when the said lock-bolt structure 21 is translated transversely, the first end 261 is driven by the longitudinal slot 213 to rotate the first transmission piece 26 simultaneously.

A plate shaped actuator 27 which is provided with a transverse slot 271 corresponding to the second end 262 of the said first transmission piece 26, whereof the said second end 262 is inserted upward from underside the said actuator 27 into the transverse slot 271, and the top and bottom ends of the said actuator 27 are respectively connected with a pull rod 28, whereof each pull rod 28 is connected with an auxiliary lock-bolt 29, and the actuator 27 and the said two pull rods 28 are driven by the transmission piece 26 to move up and down to push the two top and bottom lock-bolt 29 out for locking action.

At least one push piece 31 which is hinged on the case 1 and has a push face 311. In the example, there are two push pieces, the hinge of the push piece 31 on the case 1 is further provided with a polygon through hole 312 for insertion of the door handle spindle (not shown in the figure). In the embodying example, a torsion spring 313 is ringed on the hinge of the said push piece 31 on the case 1. In the embodying example, a stopper 314 is installed at one side of the said push piece 31 for blocking the said push piece 31 in order to balance the spring force of the said torsion spring 313 so that the said push piece 31 can be positioned at the design location.

A V shaped second transmission piece 32 is hinged on the said case 1 at its V shaped bend, in which the said second transmission piece 32 has a third end 321 and a fourth end 322, whereof the third end 321 is installed against and pushed by the push piece 31, and the rotating direction of the said push piece 31 is different from the rotating direction of the second transmission piece 32; In addition, the direction of opening between the first and second ends 261, 262 of the first transmission piece 26 is contrary to the direction of opening between the third and fourth ends 321, 322 of the second transmission piece, whereof the opening of the said first transmission piece 26 is facing the side edge of the door while the opening of the said second transmission piece 32 is facing away from the side edge of the door.

A lock-tongue structure 33 which is transversely installed on the case 1, whereof the lock-tongue structure 33 is installed with a lock-tongue head 331 which can be extended through the lock-tongue through hole 12, further, a stop part 332 is installed at the opposite end on the lock-tongue structure 33 far away from the lock-tongue head 331, whereof the side facing lock-tongue 331 of the stop part 332 is pushed against by the fourth end 322 of the second transmission piece, whereby the stop part 332 is pushed by the hinged rotation of the second transmission piece 32 to make the lock-tongue structure 33 translate inward transversely. Another side of the stop part 332 is pushed by an elastic component 34 installed on the case 1 to make the lock-tongue structure 33 translate to the lock-tongue through hole transversely. Herein, the elastic component 34 is a torsion spring. In the embodying example, a third transverse guide slot 16 is defined at the base plate of the case 1 corresponding to the lock-tongue structure 33, whereof the lock tongue structure 33 is installed with a raised piece 333 for inserting into the third transverse guide slot 16.

In the embodying example, one side of the said case 1 is installed with an outside-facing separating plate 4, whereof the two ends of the said separating plate 4 are extended outward along the two pull rods 28. The said lock-bolt through hole 11 and the said lock-tongue through hole 12 are separately installed on the said separating plate 4 in this example. Further, the said separating plate 4 as well as the top and bottom pull rods 28 are assembled by multiple fixing pieces, whereof each said fixing piece 41 has a center screwed hole 411, so that multiple screws can be used to screw in the corresponding screwed holes thereby to firmly install the said door lock inside the side of door.

Figure 4:
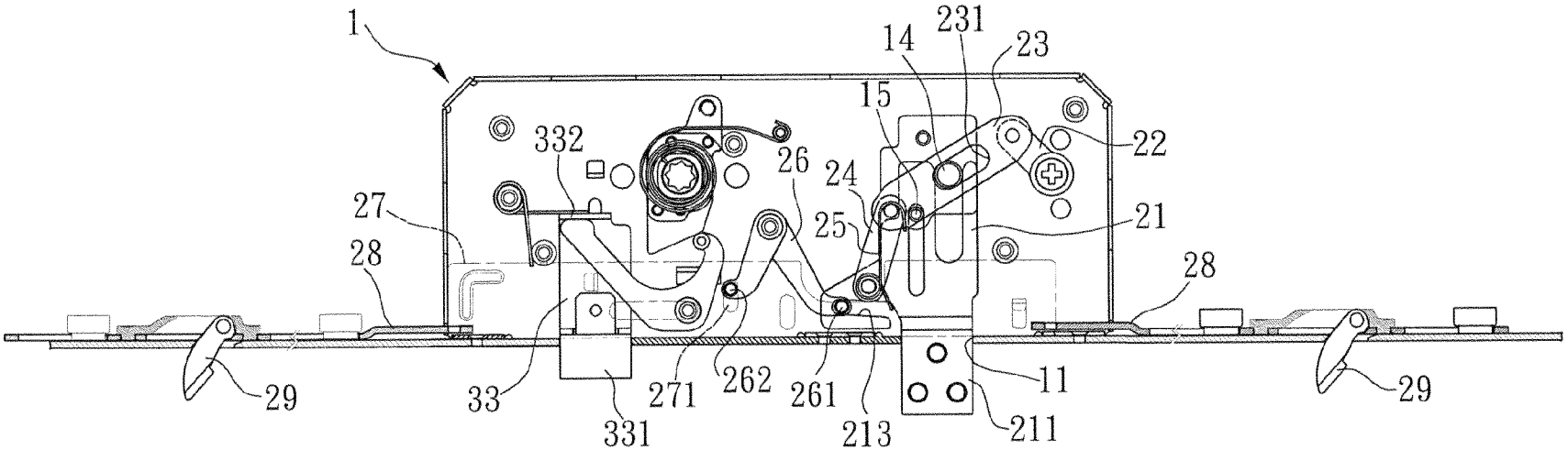
FIG. 4 is a side view of the structure in FIG. 1 after assembly, wherein the lock-bolt structure and lock-tongue structure are at closing status.
Figure 5:
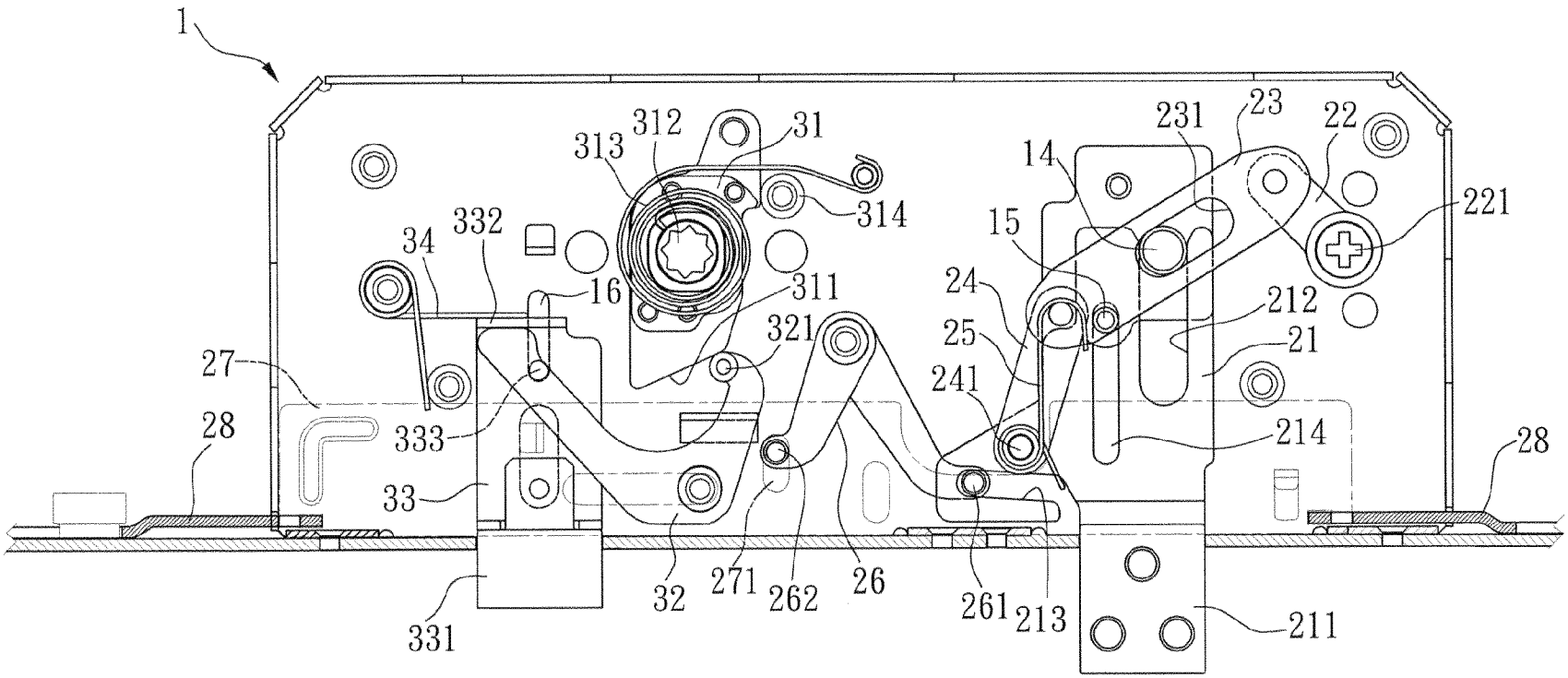
FIG. 5 is an enlarged schematic view of FIG. 4.

Please refer to FIGS. 4 and 5 for the status drawing of a closing lock. In practical use, if the door is lock closed with a key, the said rotating knob (not shown in the figure) is rotated by the key, whereby the said swing arm 22 is rotated in the direction away from the said lock-bolt through hole 11. In the figure of this example, the said swing arm 22 is rotated clockwise (the clockwise, counterclockwise rotations are for description shown in the figures only, not a limitation). The first link bar 23 is driven by the said swing arm 22 to rotate clockwise with the said rod 14 as the center of rotation, whereof the guide slot 231 of the first link bar 23 is translated in reciprocation corresponding to the said rod 14. In addition, the said second link bar 24 is driven by the said first link bar 23 to rotate and translate transversely to the said lock-bolt through hole 11. At the same time the said lock-bolt structure 21 is driven by the said second link bar 24 to translate outward in transverse direction, thereby the said lock-bolt head 211 is extended out of the said lock-bolt through hole 11, and the said lock-bolt head 211 is then inserted and locked into the lock-bolt hole of the door frame to complete the lock closing action.

As described from the above, when the lock-bolt structure 21 of the invention is locked up, the top and bottom auxiliary lock-bolts 29 are driven simultaneously to lock up too. whereof since the first end 261 of the first transmission piece 26 is inserted into the longitudinal slot 213 when the said lock-bolt structure 21 is translated outward in transverse direction, the first end 261 is pushed outward in transverse direction by the wall of the said longitudinal slot 213 and the said first transmission piece 26 is rotated clockwise, the second end 262 of the said first transmission piece 26 is transversely retreated inward through the transverse slot 271 of the said actuator 27, whereof the said second end 262 is pushed by the wall of the transverse slot 271 to drive the first transmission piece 26 to translate longitudinally. As such, the two top and bottom pull rods 28 can be driven by the said actuator 27 to make the two auxiliary lock-bolts 29 extend outward and insert into the top and bottom lock holes of the door frame respectively for locking.

In addition, by installing the said labor saving component 25 (i.e. torsion spring), structure members such as the swing arm 22, the first link bar 23 and the second link bar 24 are driven sequentially by the key rotation, and due to the design of the labor saving component 25, when the swing arm 22, first link bar 23 and second link bar 24 are rotated during the design operation period of the invention, the said labor saving component 25 can then push the said link bar 23, second link bar 24 and the said lock-bolt structure 21 outward accordingly, thereby to offer the user a more labor saving and convenient way in rotating the key for door locking.

Figure 6:
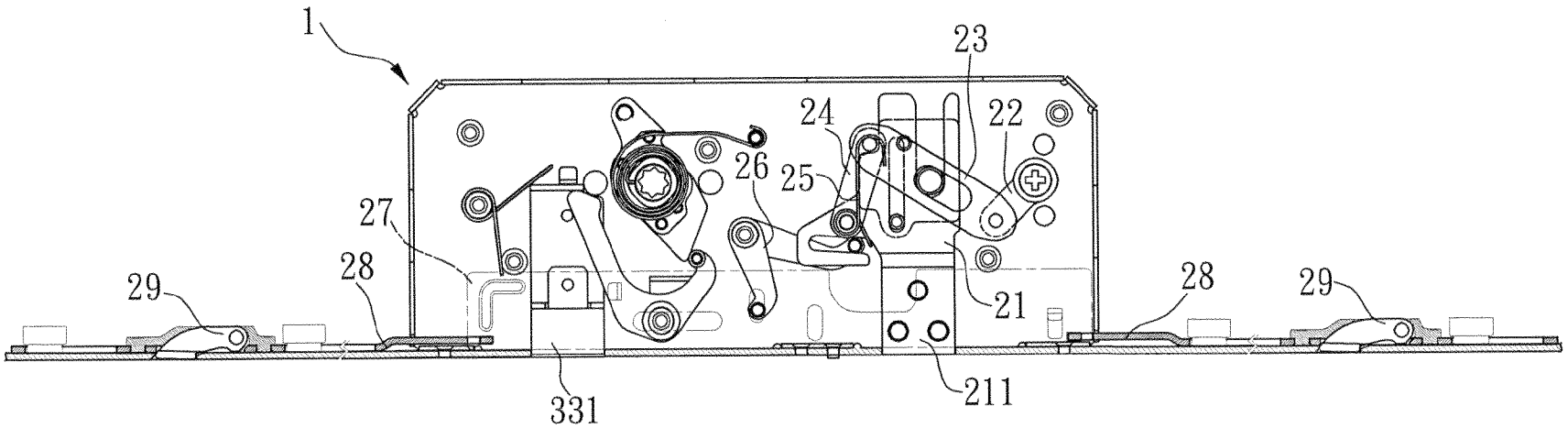
FIG. 6 is a side view of the structure in FIG. 1 after assembly, wherein the lock-bolt structure and lock-tongue structure are at opening status.
Figure 7:
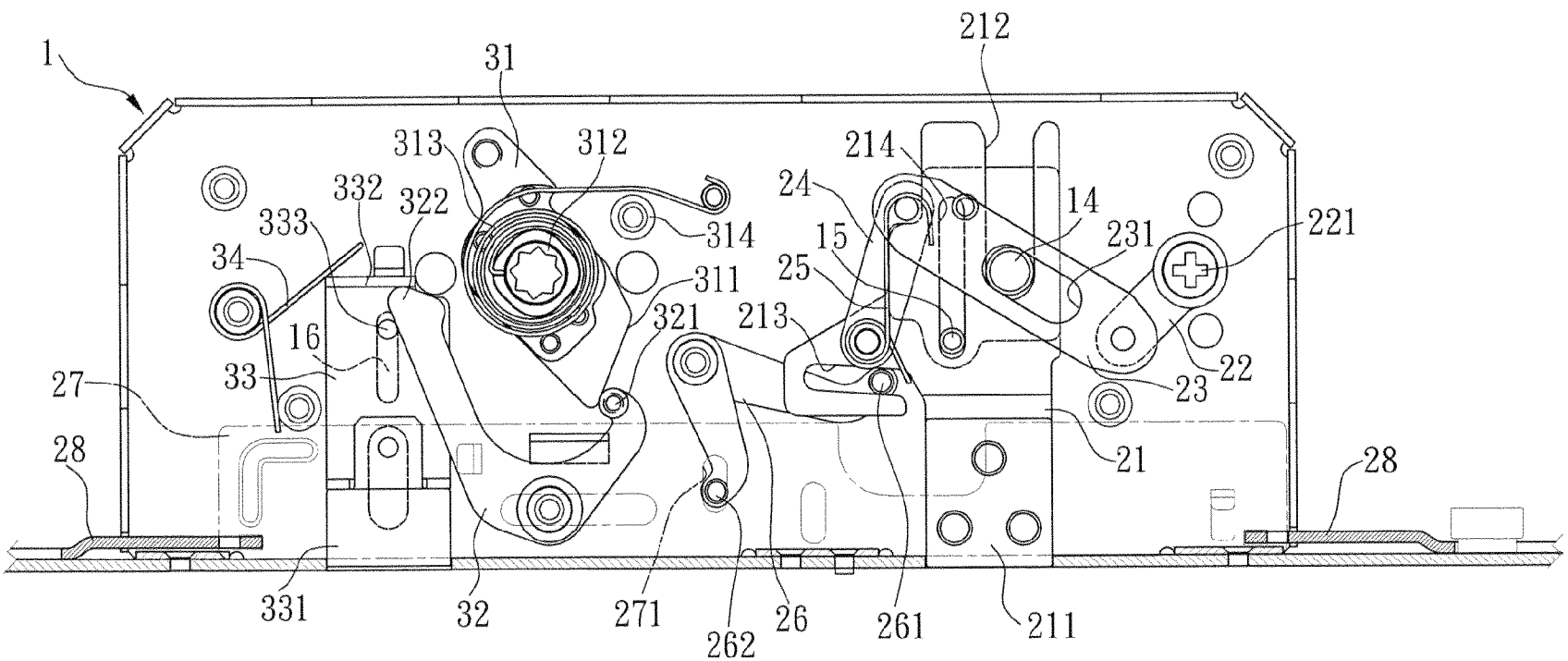
FIG. 7 is an enlarged schematic view of FIG. 6.
Figure 8:
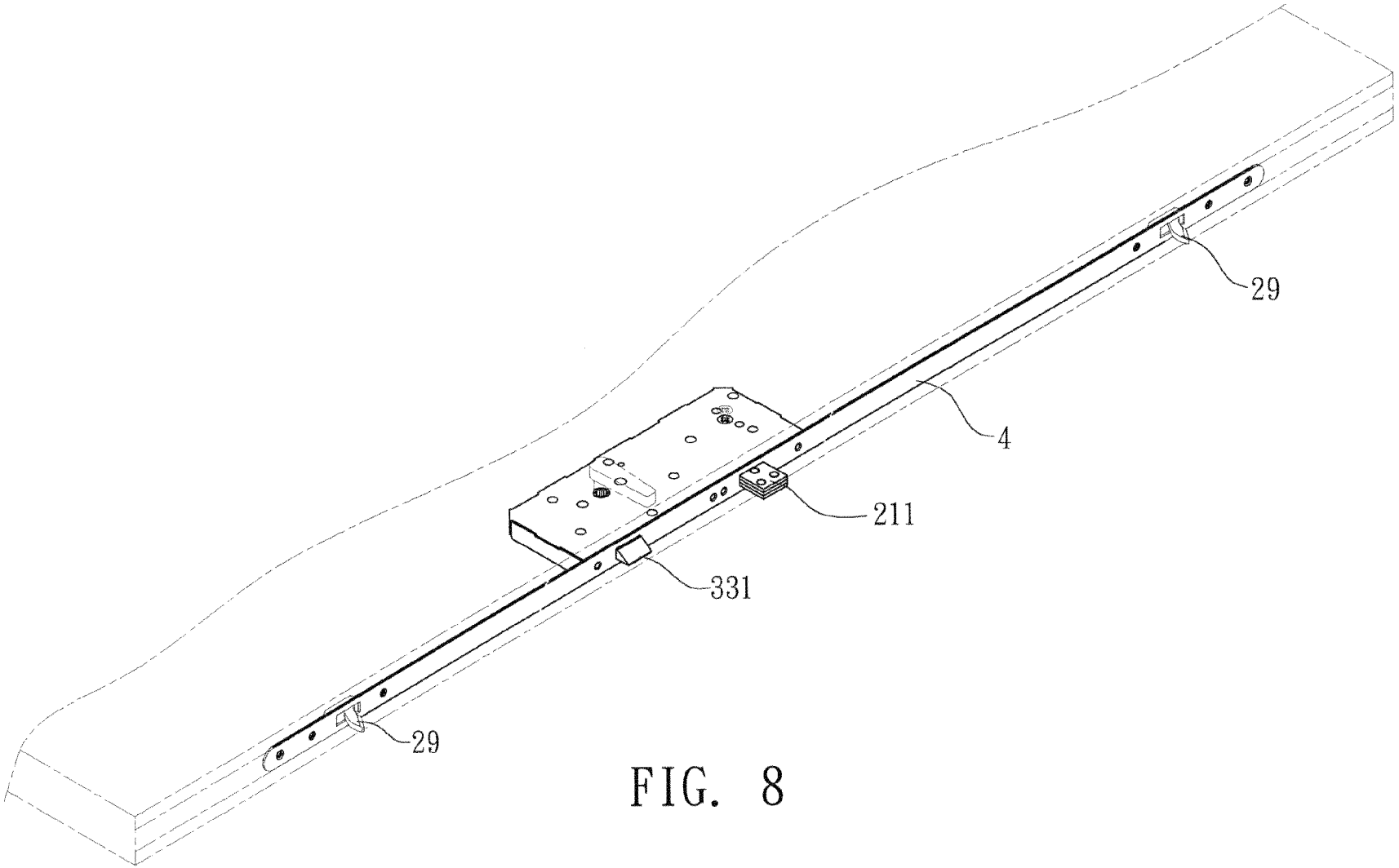
FIG. 8 is a schematic view showing that the door lock of the invention is installed on the door.

Please refer to FIGS. 6 and 7 for the status drawing of an open lock. When the door is opened with a key, the key is rotated and through the rotating knob (not shown in the figure) to drive the swing arm 22 for counterclockwise rotation and drive the first link bar 23 for clockwise rotation, whereof the second link bar 24 is driven by the said first link bar 23 to rotate for retreat, the lock-bolt structure 21 is driven by the said second link bar 24 to retreat transversely and the said lock-bolt head 211 is retreated back to side of the said case 1, thereby to release the lock closing status of the door.

When the two top and bottom auxiliary lock-bolts 29 and the lock-bolt structure 21 are retreated transversely, the first transmission piece 26, and the actuator 27, as well as the top and bottom pull rods 28, are sequentially driven by the lock-bolt structure 21, thereby releasing the locking statuses of the two top and bottom lock-bolts.

Further, if the door is intended to open, while the structure members of the said swing arm 22, the first link bar 23 and the second link, bar 24, etc W are in action, the lock-bolt structure is pulled back transversely by corresponding push of the labor saving component 25 of the said second link bar 24, thereby to offer the user a more labor saving and convenient way in rotating the key for door opening.

Further, even when the door is not actually lock closed by the key, i.e. the lock-bolt head 211 of the said lock-bolt structure 21 is not extended outward, the door and door frame can be closed through insertion of the lock-tongue head 331 of the lock-tongue structure 33 into the lock-tongue hole of the door frame (not shown in the figure).

For the time being, it is only needed to rotate the door handle manually and drive the door handle spindle to further drive the said push piece 31 for counterclockwise rotation (the clockwise, counterclockwise rotation are only for easy description of the figures), whereby the third end 321 of the second transmission piece 32 is pushed by the push face 311 of the said push piece 31 to make the said second transmission piece 32 to rotate clockwise, and the stop part 332 of the said lock-tongue structure 33 is pushed by the fourth end 322 of the said second transmission piece 32 to cause the said lock-tongue structure 33 to retreat inward transversely, thereby the door can be opened.

As said above, as another side of the stop part 332 of the said lock-tongue structure 33 is pushed outward transversely by the elastic component 34 (torsion spring) to guide the lock-tongue head 331 to extend out accordingly through its guiding slope, thereby the door is easily closed with the door frame.

As summarized from the above description, the invention has many advantages, such as the design by the structure members of the swing arm 22, the first link bar 23, the second link bar 24 and the lock-bolt structure 21, etc. in combined action along with the cooperation of the labor saving component 25 (i.e. torsion spring) to allow the user to open or close the door with a key in a more labor saving and convenient way that is much better than the conventional arts. At the same time, since the two top and bottom auxiliary lock-bolts 29 are driven by the lock-bolt structure 21 to open or close lock simultaneously, it also has a much better burglarproof function.

The invention claimed is:

1. A door lock of key-driven transmission structure comprising:

a case with a lock-bolt through hole, a lock-tongue through hole;

a lock-bolt structure transversely installed in the case, the lock-bolt structure having a lock-bolt head which extends through the lock-bolt through hole, and the lock-bolt structure further having a first transverse guide slot, in which a rod from a base plate of the case is inserted, and also a longitudinal slot at an outer edge between the lock-bolt head and the first transverse guide slot on the lock-bolt structure;

a swing arm hinged on the base plate and on the opposite side of the longitudinal slot of the lock-bolt structure;

a first link bar with one end hinged on the swing arm, and the first link bar striding across the lock-bolt structure, whereof a guide slot is defined between two ends of the first link bar and the rod is inserted therein, whereby when the first link bar is driven by the swing arm, rotation of the first link bar is limited by the rod;

a second link bar with one end hinged on the first link bar and driven by first link bar to rotate, another end of the second link bar is hinged on the lock-bolt structure near the longitudinal slot, whereby the lock-bolt structure is driven by the second link bar causing the lock-bolt head to shrink in or extend out through the lock-bolt through hole;

a labor saving component is installed on the second link bar, whereof the labor saving component is connected with the first link bar and the lock-bolt structure, thereby making transverse translation of the lock-bolt structure in a more labor saving and convenient way;

a first transmission piece hinged on the base plate of the case near the longitudinal slot, said first transmission piece has a first end and a second end, the first end is inserted into the longitudinal slot, when the lock-bolt structure is translated transversely, the first end is driven by the longitudinal slot to rotate the first transmission piece;

an actuator provided with a transverse slot corresponding to the second end of the first transmission piece, the top and bottom ends of the actuator are respectively connected with two pull rods, whereof each pull rod is connected with an auxiliary lock-bolt, and the actuator and the two pull rods are driven by the first transmission piece to move up and down to push the two top and bottom lock-bolts out for locking action;

at least one push piece hinged on the case and has a push face;

a second transmission piece hinged on the case, in which the second transmission piece has a third end and a fourth end, whereof the third end is installed against and pushed by the push piece, and the rotating direction of the push piece is different from the rotating direction of the second transmission piece; and a lock-tongue structure which is transversely installed on the case, whereof the lock-tongue structure is installed with a lock-tongue head which can be extended through the lock-tongue through hole, a stop part is installed at the opposite end on the lock-tongue structure far away from the lock-tongue head, whereof the side facing lock-tongue of the stop part is pushed against by the fourth end of the second transmission piece, whereby the stop part is pushed by the hinged rotation of the second transmission piece to make the lock-tongue structure translate inward transversely, another side of the stop part is pushed by an elastic component installed on the case to make the lock-tongue structure translate to the lock-tongue through hole transversely.

2. A door lock of key-driven transmission structure as in claim 1, in which one side of the case is installed with a separating plate, whereof two ends of the separating plate are extended outward along the two pull rods.

3. A door lock of key-driven transmission structure as in claim 2, in which the separating plate as well as the top and bottom pull rods are assembled by multiple fixing pieces, whereof each said fixing piece has a center screwed hole.

4. A door lock of key-driven transmission structure as in claim 1, whereof a cover plate is further provided on top of the case for closing with it.

5. The door lock of key-driven transmission structure of claim 1, in which the hinge of the swing arm is installed with a lock-hole.

6. The door lock of key-driven transmission structure as in claim 1, whereof a second transverse guide slot parallel to the first transverse guide slot is further provided on the lock-bolt structure, and the second transverse guide slot is inserted by a stud on the base plate of the case.

7. The door lock of key-driven transmission structure as in claim 1, whereof the labor saving component is a torsion spring which is ringed on a hinge rod at the hinge between the second link bar and the lock-bolt structure, whereof one end of the labor saving component is connected to a hinge between the first link bar and the second link bar and the another end is connected with the lock-bolt structure.

8. The door lock of key-driven transmission structure as in claim 1, in which a torsion spring is ringed on the hinge of the push piece on the case for recovering the push piece.

9. A door lock of key-driven transmission structure as in claim 8, in which a stopper is installed at one side of the push piece for blocking the push piece in order to balance the spring force of the torsion spring.

10. A door lock of key-driven transmission structure as in claim 1, in which the hinge of the push piece on the case is further provided with a polygon through hole for insertion of a door handle spindle.

11. The door lock of key-driven transmission structure as in claim 1, in which the elastic component is a torsion spring.

12. A door lock of key-driven transmission structure as in claim 1, whereof a third transverse guide slot is installed at the base plate of the case corresponding to the lock-tongue structure, whereof the lock-tongue structure is installed with a raised piece.

* * * * *